US005123947A

United States Patent [19]

Agrawal

[11] Patent Number: 5,123,947

[45] Date of Patent: Jun. 23, 1992

[54] CRYOGENIC PROCESS FOR THE SEPARATION OF AIR TO PRODUCE ULTRA HIGH PURITY NITROGEN

[75] Inventor: Rakesh Agrawal, Allentown, Pa.

[73] Assignee: Air Products and Chemicals, Inc., Allentown, Pa.

[21] Appl. No.: 638,853

[22] Filed: Jan. 3, 1991

[51] Int. Cl.[5] ..... F25J 3/02

[52] U.S. Cl. ..... 62/27; 62/38; 62/42

[58] Field of Search ..... 62/24, 38, 27, 32, 42, 62/44

[56] References Cited

U.S. PATENT DOCUMENTS

| | | | |
|---|---|---|---|
| 4,303,428 | 12/1981 | Vandenbussche | 62/38 |
| 4,705,548 | 11/1987 | Agrawal et al. | 62/38 |
| 4,783,210 | 11/1988 | Ayres et al. | 62/24 |
| 4,824,453 | 4/1989 | Rottman et al. | 62/22 |
| 4,902,321 | 2/1990 | Cheung | 62/24 |
| 4,957,523 | 9/1990 | Zarate et al. | 62/24 |

FOREIGN PATENT DOCUMENTS 376465 7/1990 European Pat. Off. .

*Primary Examiner*—Ronald C. Capossela

*Attorney, Agent, or Firm*—Russell L. Brewer; James C. Simmons; William F. Marsh

[57] ABSTRACT

This invention relates to a cryogenic process for the separation of air utilizing an integrated multi-column distillation system wherein an ultra high purity nitrogen product is generated. In the cryogenic distillation separation of air, air is initially compressed, pretreated and cooled for separation into its components. Ultra high purity, e.g., nitrogen typically having less than 0.1 ppm impurities is generated in a multi-column distillation system comprising a first column and an ultra high purity nitrogen column with enhanced nitrogen product recovery by withdrawing a gaseous nitrogen fraction from a first column and charging the fraction as a feed to the ultra high purity nitrogen column, withdrawing a nitrogen stream which is rich in volatile contaminants from the top of the ultra high purity nitrogen column and recovering a nitrogen product at a point below the removal point of the nitrogen rich stream containing volatile components. Removal of volatile components in the distillation process is effected by partially condensing a nitrogen vapor stream from either the first column or the ultra high purity column and removing at least one of the uncondensed portions of the nitrogen rich stream containing volatile components as a purge stream.

20 Claims, 5 Drawing Sheets

CRYOGENIC PROCESS FOR THE SEPARATION OF AIR TO PRODUCE ULTRA HIGH PURITY NITROGEN

TECHNICAL FIELD OF THE INVENTION

This invention relates to cryogenic process for the separation of air for recovering ultra high purity nitrogen with high nitrogen recovery.

BACKGROUND OF THE INVENTION

Numerous processes are known for the separation of air into its constituent components by cryogenic distillation. Typically, an air separation process involves removal of contaminant materials such as carbon dioxide and water from a compressed air stream prior to cooling to near its dew point. The cooled air then is cryogenically distilled in an integrated mulit-column distillation system producing oxygen, nitrogen, and argon. One type of distillation system employs a high pressure column, a low pressure column and, optionally, a side arm column for the separation of argon. The side arm column for the separation of argon typically communicates with the low pressure column in that an argon/oxygen stream containing about 8–12% argon is removed and cryogenically distilled.

Variations on the above processes to produce an ultra high purity nitrogen stream containing volatile or light contaminants, such as hydrogen, helium and neon have been proposed. Concentration of some of these contaminants in the feed air can be as high as 20 ppm. Almost all of these light components show up in final nitrogen product from an air separation unit (ASU). In some cases, such as for the electronic industry, this contamination level is unacceptable in the end use of this nitrogen product. Ultra high purity nitrogen processes reduce the level of impurities to less than 5 ppm and typically less than 0.1 ppm contaminants.

The following patents disclose approaches to the problem.

U.S. Pat. No. 4,824,453 discloses a process for producing ultra high purity oxygen as well as high purity nitrogen, where the nitrogen purity exceeds 99.998% and the amount of impurities is generally less than 10 ppm. More specifically, air is compressed, cooled and distilled in a rectification system wherein in a first stage rectification an oxygen enriched fraction is removed from the bottom and a nitrogen rich liquid fraction is removed from an upper portion of the first stage rectification. The nitrogen rich liquid is sub-cooled and returned as reflux to the top of the second stage rectification. A nitrogen rich liquid is removed from an upper portion of the second stage and nitrogen vapor removed from the second stage rectification at a point above the liquid removal point. Liquid oxygen from the bottom of the first stage is sub-cooled, expanded and used to drive a boiler/condenser in the top of a high purity argon column. Nitrogen vapor from the top of the first stage is used to drive a boiler/condenser in the bottom of a high purity oxygen column. To enhance product purity, a portion of the gaseous nitrogen stream from the top of the high pressure column rich in impurities is removed as purge.

U.S. Pat. No. 4,902,321 discloses a process for producing ultra high purity nitrogen in a multi-column system. Air is compressed, cooled and charged to a high pressure column where it is separated into its own components generating an oxygen liquid at the bottom and a nitrogen rich vapor at the top. The oxygen liquid is expanded and used to drive a boiler/condenser which is thermally linked to the top of the high pressure column for condensing the nitrogen rich vapor. A portion of the nitrogen rich vapor is removed from the top of the high pressure column and condensed in the tube side of a heat exchanger which is operated as a reflux condenser. The resulting liquid nitrogen is expanded and charged to the top of a stripping column wherein nitrogen, including impurities, are flashed from the stripping column. Any impurities not removed by flashing are stripped by passing a stream of substantially pure nitrogen upwardly through the column. The nitrogen liquid collected at the bottom of the stripping column is pumped to the shell side of the heat exchanger, vaporized against the nitrogen-rich vapor and removed as high purity product.

European Patent 0 0376 465 discloses an air separation process for producing ultra high purity nitrogen product. In the process, nitrogen product from a conventional air separation process is charged to the bottom of a column equipped with a reflux condenser. Liquid nitrogen is withdrawn from an upper portion of the column and flashed generating a liquid and a vapor. The liquid obtained after flashing is then flashed a second time and the resulting liquid recovered.

There are essentially two problems associated with the processes described for producing ultra-high purity nitrogen and these problems relate to the fact that in the '453 disclosure nitrogen purities are quite often not sufficiently high to meet industry specifications and in the '321 process nitrogen recoveries are low.

SUMMARY OF THE INVENTION

This invention relates to an air separation process for producing ultra high purity nitrogen with high nitrogen recovery. In the basic cryogenic process for the separation of air which comprises nitrogen, oxygen and condensible and volatile impurities, an air stream is compressed, freed of the condensible impurities, and cooled generating a feed for an integrated multi-column cryogenic distillation system. In the integrated multi-column distillation system, nitrogen is recovered as a product. The improvement in this basic process for producing ultra high purity nitrogen at high nitrogen recovery in an integrated multi-column distillation system comprising a first column and an ultra high purity nitrogen column comprises:

a) generating a nitrogen rich vapor fraction containing volatile impurities near the top of said first column and a crude liquid oxygen fraction at the bottom of said first column;

b) removing a nitrogen rich vapor fraction from a top section within said first column;

c) introducing at least a portion of that nitrogen rich vapor from said first column to said ultra high purity nitrogen column as a feed;

d) generating a nitrogen rich vapor fraction near the top of said ultra high purity nitrogen column and an ultra high purity liquid nitrogen fraction in a lower portion of said ultra high purity nitrogen column;

e) partially condensing at least one of said nitrogen rich vapor fractions generated in step a) or d) or both thereby forming a condensed fraction and an uncondensed fraction rich in volatile impurities;

f) removing at least a portion of at least one of the uncondensed fractions rich in volatile impurities as a purge stream;

g) returning at least a portion of at least one of the condensed fractions generated in step (e) to at least one of the columns as reflux;

h) removing a crude oxygen fraction from the bottom portion of said first column; and, i) removing an ultra high purity nitrogen fraction as product from the ultra high purity nitrogen column.

Significant advantages for obtaining ultra high purity nitrogen at high recovery are achieved by concentrating volatile impurities in purge streams and minimizing the volume of these purge streams at strategic locations in the process. The processes of this invention permit one to recover product nitrogen at a high recovery rate; generate ultra high purity nitrogen at inlet air supply pressure, to coproduce oxygen and the ability to control levels of ultra high purity nitrogen and standard nitrogen produced by the plant.

DRAWINGS

DETAILED DESCRIPTION OF THE INVENTION

Figure 1:
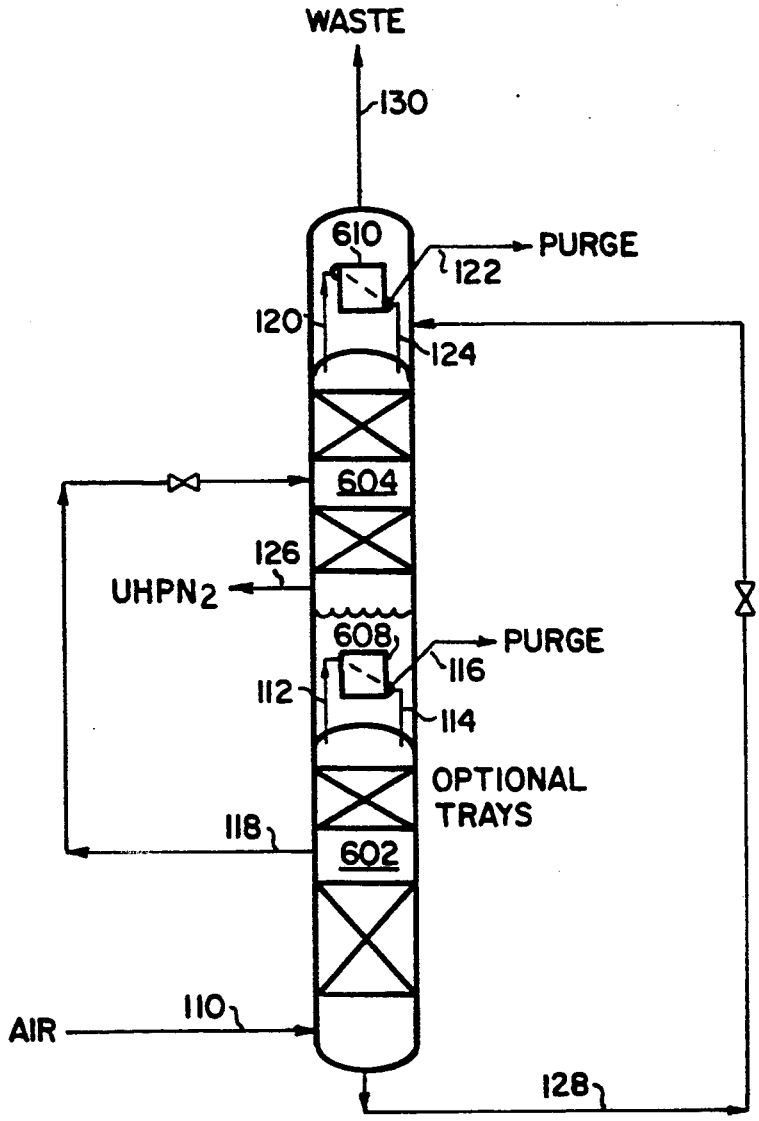
FIG. 1 is a schematic representation of an embodiment for generating ultra high purity nitrogen with enhanced nitrogen recovery.

To facilitate an understanding of the invention and the concepts for generating an ultra high purity nitrogen product having a volatile impurity content of less than 5 ppm and preferably less than 0.1 ppm, reference is made to FIG. 1. More particularly, a feed air stream 110 is initially prepared from an air stream by compressing an air stream comprising oxygen, nitrogen, argon, volatile impurities such as hydrogen, neon, helium, and the like, and condensible impurities, such as, carbon dioxide and water in a multi-stage compressor system to a pressure ranging from about 80 to 300 psia and typically in the range of 90–180 psia. These volatile impurities have a much lower boiling point than nitrogen. This compressed air stream is cooled with cooling water and chilled against a refrigerant and then passed through a molecular sieve bed to free it of condensible water and carbon dioxide impurities.

The integrated multi-column distillation system comprises a first column 602 and an ultra high purity nitrogen column 604. First column 602 typically is operated at a pressure close to the pressure of feed air stream 110, e.g., 80 to 300 psia and air is separated into its components by intimate contact of the vapor and liquid in the column. First column 602 is equipped with distillation trays or packing, either medium being suited for effecting liquid/vapor contact. A high pressure nitrogen vapor stream containing volatile impurities is generated at the top portion of first column 602 and a crude liquid oxygen stream is generated at the bottom of first column 602.

Ultra high purity nitrogen column 604 is operated within a pressure range from about 15–300 psia and preferably in the range of about 10 to 55 psia lower than the pressure in first column 602 in order to produce an ultra high purity nitrogen product. The objective in the ultra high purity nitrogen column is to provide ultra high purity nitrogen generally in a lower section of ultra high purity nitrogen column 604 with minimal loss. Ultra high purity nitrogen column 604 is equipped with vapor liquid contact medium which comprises distillation trays or packing.

In the process of FIG. 1, stream 110, which is free of condensible impurities and cooled to near its dew point in a main heat exchanger system (not shown), forms the feed to first column 602 associated with the integrated multi-column distillation system. A high pressure nitrogen rich vapor containing volatile impurities is generated as an overhead and a liquid oxygen fraction as a bottoms fraction. A portion of the high pressure nitrogen vapor generated in first column 602 is withdrawn via line 112 and substantially all of it is condensed in boiler/condenser 608 shown in the lower portion of ultra high purity nitrogen column 604. Condensation of the nitrogen rich vapor containing impurities provides boil-up and the partial condensation of the nitrogen vapor reduces the level of volatile impurities in the condensed liquid phase which is formed. Partial condensation thus concentrates the volatile impurities in the vapor phase. The condensed nitrogen fraction is withdrawn from boiler/condenser 608 and at least a portion is directed to first column 602 as reflux via line 114. The uncondensed balance of the high pressure nitrogen fraction is removed via line 116 as a purge and discharged as waste.

It is in ultra high purity nitrogen column 604 where the ultra high purity nitrogen product is produced. In the embodiment of FIG. 1, a nitrogen vapor stream is withdrawn from the top section of the first column 602 via line 118, expanded and fed to an intermediate point in ultra high purity nitrogen column 604. A nitrogen rich stream is generated in the the top or upper most portion of the ultra high purity nitrogen column 604. Depending on the amount of impurities removed in first column 602, some volatile impurities will be present in the upper most portion of ultra high purity nitrogen column 604. The nitrogen rich fraction containing volatile impurities is removed as an overhead via line 120 and partially condensed in boiler/condenser 610. Uncondensed gases which are rich in volatile impurities are removed as a purge stream via line 122 with the condensed fraction being returned to ultra high purity nitrogen column 604 via line 124. Boil-up in ultra high purity nitrogen column 604 is obtained through boiler/condenser 608 as shown and this boil-up results in a vapor fraction being generated at the bottom of ultra high purity nitrogen column 604. An ultra high purity nitrogen product, e.g., product containing less than 5 ppm and preferably less than 0.1 ppm residual contaminants is removed via line 126 at a point below the removal point for volatile impurities in column 604 as a vapor fraction. Optionally, ultra high purity nitrogen liquid can also be withdrawn as product from the bottom of ultra high purity nitrogen column 604.

In accordance with many standard cryogenic nitrogen generators oxygen is utilized for refrigeration purposes and exhausted as waste. To obtain the necessary refrigeration for producing ultra high purity nitrogen product in this process crude liquid oxygen is removed via line 128, expanded and vaporized against the overhead from ultra high purity nitrogen column 604 via line 120. The vaporized crude liquid oxygen then is removed as a waste product via line 130.

One variation of the process described in FIG. 1 would involve the splitting of the feed nitrogen vapor fraction from first column 602 to ultra high purity nitrogen column 604 via line 118 into two portions. One portion would be condensed against the crude liquid oxygen in boiler/condenser 610 and returned as reflux to first column 602. The other portion would be charged to ultra high purity nitrogen column 604 as shown. By effecting direct condensation of a fraction of the nitrogen vapor removed via line 118 in boiler/condenser 610, one can reduce the heat duty for boiler/condenser 608 in ultra high purity nitrogen column 604 and as well as decrease the amount of vapor flow in ultra high purity nitrogen column 604. And, if a portion of the volatile contaminants in the nitrogen rich gas is removed as a purge, the vapor feed to ultra high purity nitrogen column 604 may be reduced. As a result of these two actions, the size, and therefore the capital and operating costs associated with producing ultra high purity nitrogen, can be reduced. Another variation is to substantially condense all of the nitrogen rich fraction containing volatile impurities (stream 112) in boiler/condenser 608 and further concentrate and remove volatile contaminants at another point. If that is the case, no purge is taken via line 116 and, therefore, there would be no need for trays between withdrawal points 112 and 118.

FIGS. 2–5 represent schematic diagrams of other embodiments and variations of the process of FIG. 1 for generating ultra high purity nitrogen product in the ultra high purity nitrogen column. A numbering system similar to that of FIG. 1 has been used for common equipment and streams and comments regarding column separations may be limited to the significant differences between this process and that described in FIG. 1.

Figure 2:
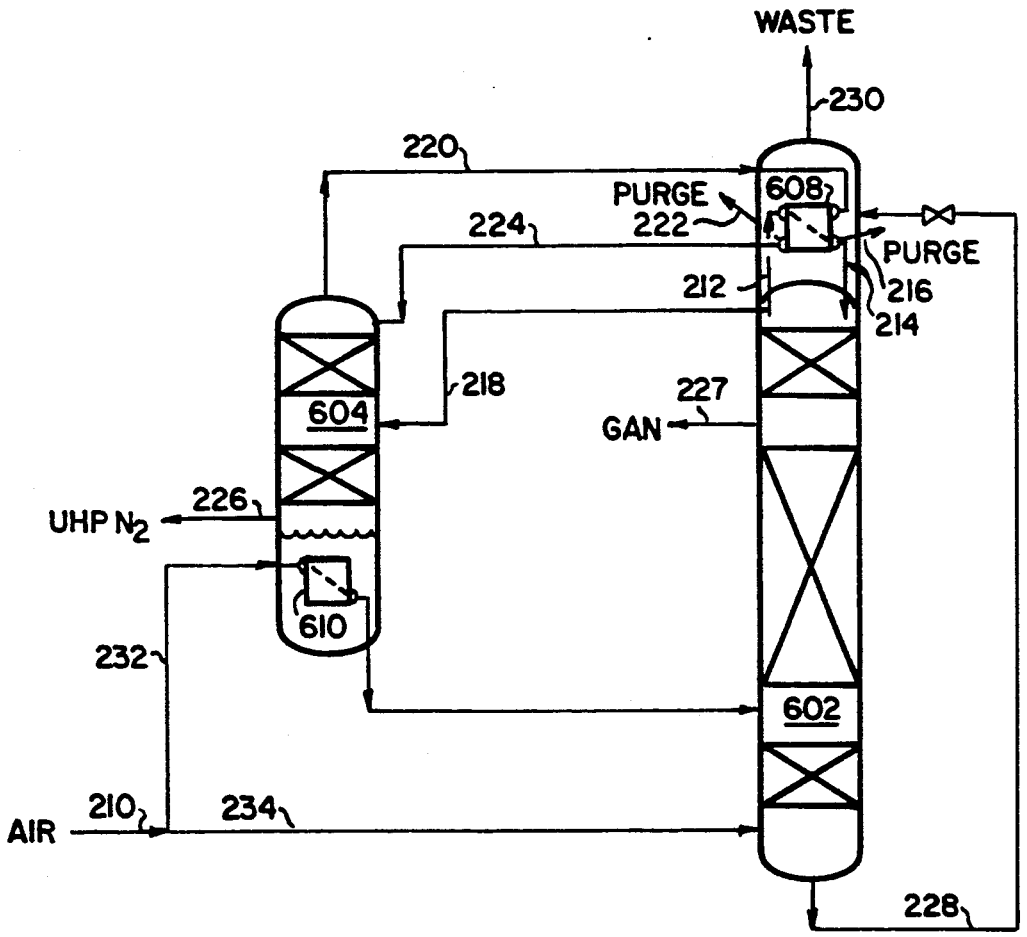
FIG. 2 is a schematic representation of a variation of the process in FIG. 1 wherein ultra high purity nitrogen is produced at air inlet supply pressure, and there is an ability to control the level of ultra high purity and standard purity nitrogen produced.

Referring to FIG. 2, ultra high purity nitrogen column 604 operates at about the same pressure as first column 602. Recall in the process of FIG. 1 a nitrogen vapor fraction was removed from a top section of first column 602 and expanded with a portion or all being introduced to a middle portion of ultra high purity nitrogen column 604. To achieve the recovery of ultra high purity nitrogen product at a pressure almost equal to the inlet air supply pressure, the process of FIG. 2 takes advantage of the incoming air stream as a means for effecting the desired boil-up in ultra high purity nitrogen column 604. More particularly, the process comprises splitting an air stream which has been freed of impurities and cooled to near its dew point, as represented by line 210, into two fractions. One fraction is conveyed to boiler/condenser 610 in the bottom of ultra high purity nitrogen column 604 via line 232 with the balance of the air stream supply being introduced to a lower section of first column 602 via line 234. Some of the inlet air supplied via line 232 to boiler/condenser 610 is condensed and introduced to an intermediate point to first column 602 as impure reflux.

As in the process of FIG. 1, a nitrogen rich vapor fraction containing residual volatile impurities is generated near the top of first column 602. A nitrogen vapor fraction is removed from the upper most part of first column 602 via line 212 with a portion being condensed in boiler/condenser 608. Similarly to the process in FIG. 1, a portion of nitrogen rich vapor concentrated in residual volatile impurities is removed from the top of first column 602 via line 218 and charged to an intermediate section of ultra high purity nitrogen column 604. The balance of the nitrogen rich fraction containing volatile impurities is condensed in boiler/condenser 608 with the condensed fraction being returned via line 214 to an upper most portion of first column 602 as reflux. The uncondensed fraction concentrated in impurities is removed as a purge via line 216. Alternatively, stream 212 can be totally condensed in boiler/condenser 610 and no purge taken via line 216. Impurities then would be removed from the ultra high purity nitrogen column. An overhead is removed from ultra high purity nitrogen column 604 via line 220 and partially condensed in boiler/condenser 608. The condensed portion is returned as reflux to an upper most portion of ultra high purity nitrogen column 604 via line 224. This point is above the feed introduction feed point of the nitrogen vapor fraction containing residual impurities from first column 602. The uncondensed nitrogen fraction is removed via line 222 as a purge stream and is not returned to the distillation system. Because of the high concentration of volatile impurities in the purge stream, only a small amount of nitrogen need be vented as purge. Ultra high purity nitrogen product is removed from the integrated distillation system as a vapor fraction via line 226. Gaseous nitrogen of lesser purity is obtained from nitrogen column 602 via line 227.

A variation in FIG. 2 would allow all of the nitrogen vapor fraction to be routed via line 218 to ultra high purity nitrogen column 604 and thus the flow rate in line 212 would be nearly zero. In this variation, there would be only one nitrogen stream condensing in boiler/condenser 608. However the condensed portion (stream 224) would be split with one portion returned as reflux to the ultra high purity nitrogen column 604, as shown in this FIG. 2, while another portion would be returned as reflux to first column 602.

Figure 3:
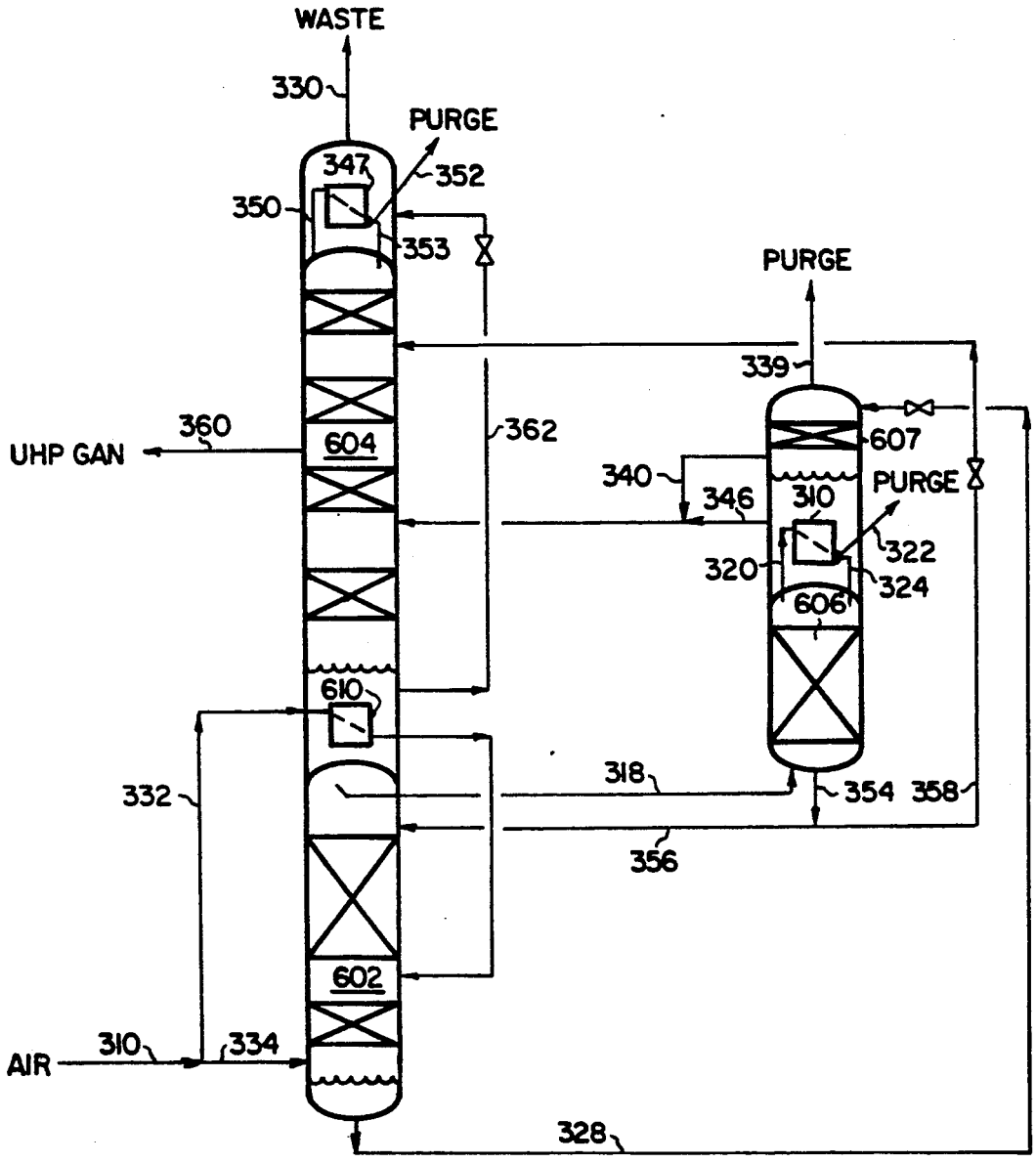
FIG. 3 is a schematic representation of a variation of the process of FIG. 1 wherein large quantites of ultra high purity nitrogen are produced.

FIG. 3 represents a variation of the process of FIG. 2 for producing large quantities of ultra high purity nitrogen. The process utilizes four columns to accomplish the separation, i.e., a first column 602, an ultra high purity nitrogen column 604, a third column 606 and a fourth column 607. An air supply is introduced to the system via line 310, split into fractions 332 and 334 wherein fraction 332 is charged to boiler/condenser 610 to provide boilup. The resulting condensed air stream is then returned to first column 602 at an intermediate point for separation. A high pressure nitrogen rich vapor fraction containing volatile contaminants is removed via line 318 and charged to the bottom of third column 606 wherein some of the volatile components are stripped from the descending liquid. A nitrogen rich vapor fraction containing a high concentration of volatile impurities is removed via line 320, partially condensed in boiler/condenser 310. At least a portion of the uncondensed nitrogen fraction rich in volatile impurities is removed as a purge via line 322 without return to the column. The balance of stream 320 is removed via line 324 and this condensed fraction is returned as reflux to third column 606.

As in the embodiments of FIGS. 1 and 2, crude liquid oxygen is removed from the first column 602 via line 328 and expanded. A portion of the subcooled liquid is partially vaporized in boiler/condenser 310. In this embodiment, distillation trays have been added above boiler/condenser 310 to form the fourth column. Crude liquid oxygen is fed at the top of the thus formed fourth column 607 and the ascending vapor strips the descending crude liquid oxygen of any dissolved impurities. The vapor stream 339 is purged. The oxygen containing vapor fraction from boiler/condenser 310 is removed via line 340 and the liquid in the sump is removed via line 346. These fractions are combined and introduced to ultra high purity nitrogen column 604 at an intermediate point. Liquid oxygen from the bottom of column 604 is removed, expanded and vaporized against a nitrogen vapor fraction in boiler/condenser 347. The nitrogen fraction is removed from the top of ultra high purity nitrogen column 606 via line 350. The uncondensed nitrogen fraction rich in volatile components is removed as a purge via line 352 and the condensed fraction returned to ultra high purity nitrogen via line 353.

The liquid from the bottom of third column 606 is removed via line 354 and split into two portions. One portion is returned to first column 602 via line 356 as reflux and the second portion isenthalpically expanded and introduced to the ultra high purity nitrogen column 604 via line 358. In this manner, nitrogen vapor containing volatile impurities is, in the final analysis, introduced to ultra high purity nitrogen column 604 as a feed. It simply has undergone an initial separation in third column 606 prior to introduction to ultra high purity nitrogen column 604. An ultra high purity gaseous nitrogen product is removed via line 360 from ultra high purity nitrogen column 604 at a location below the feed point represented by stream 358. Refrigeration for boiler/condenser 347 located at the top of ultra high purity nitrogen column 604 is effected by removing liquid oxygen from the bottom of ultra high purity nitrogen column 604 via line 362 and isenthalpically expanding and vaporizing that stream against the overhead from ultra high purity nitrogen column 604. The vaporized oxygen then is discharged via line 330 as a waste product.

Figure 4:
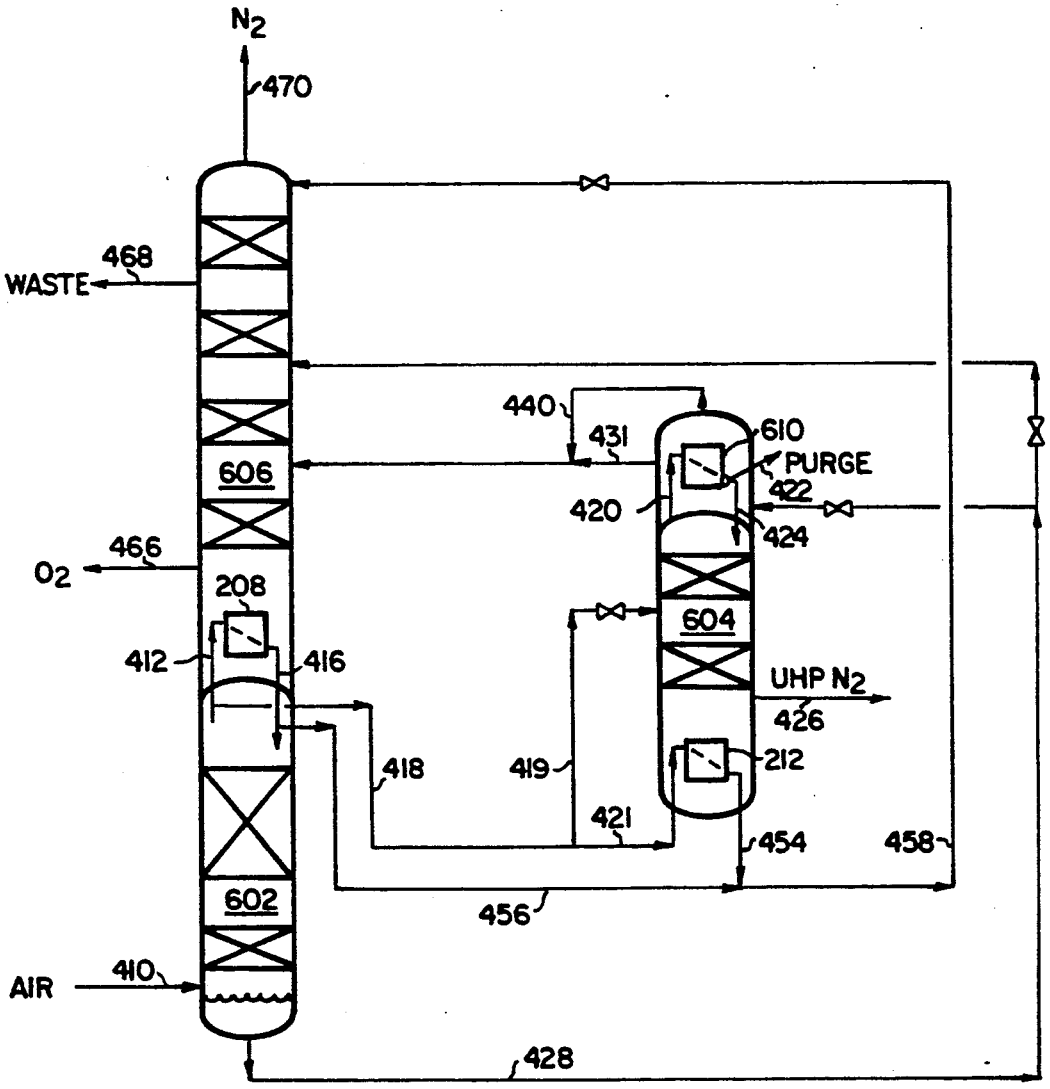
FIG. 4 is a schematic representation of a variation of FIG. 1 in that ultra high purity nitrogen and oxygen are produced.

FIG. 4 describes a variation of the process of FIG. 3. The process results in lesser quantities of ultra high purity nitrogen being produced but there is an accompanying coproduction of oxygen. The process generally involves the retaining of third column 606 as a conventional column with oxygen of high purity being withdrawn from the bottom of the column and a nitrogen product of standard purity, e.g., less than 5 ppm of oxygen being withdrawn as an overhead from that column. More particularly air is introduced to first column 602 via line 410 wherein a nitrogen rich fraction containing impurities is generated. A portion of that fraction is removed from the first column 602 via line 412 and condensed. In addition, some of the nitrogen fraction rich in volatile impurities is removed from the section via line 418 to effect boiling in ultra high purity nitrogen column 604 and provide feed. A portion is removed via line 419, expanded, and charged to an intermediate point in ultra high purity nitrogen column 604 as feed. The balance is conveyed via line 421 and condensed in the bottom of ultra high purity nitrogen column 604 in boiler/condenser 212. The condensed nitrogen fraction in line 454 is combined with a liquid nitrogen stream 456 withdrawn from the first column 602 and the combined stream 458 is isenthalpically expanded and charged as reflux to the top of third column 606. As with the process in FIG. 3, a nitrogen fraction rich in volatile impurities is removed from an upper portion of ultra high purity nitrogen column 604 via line 420 and partially condensed. The uncondensed portion is removed as a purge via line 422 and the condensed portion is returned as reflux to column via line 424. Crude liquid oxygen from the bottom of first column 602 is removed via line and a portion is used to drive boiler/condenser 610 in the top of ultra high purity nitrogen column 604. Any liquid and vaporized oxygen is removed via lines 431 and 440, combined, and charged to an intermediate point in third column 606 wherein it is distilled. Higher purity oxygen (higher than crude) is recovered from the bottom of third column 606 as a vapor via line 466. The balance of oxygen from line 428 is charged to an intermediate point of column 606. A waste stream, as with many conventional nitrogen columns, is taken from an upper portion of third column 606 via line 468 and nitrogen of standard purity is removed as an overhead product via line 470. The ultra high purity nitrogen product is removed as stream 426 from the bottom of ultra high purity nitrogen column 604.

Figure 5:
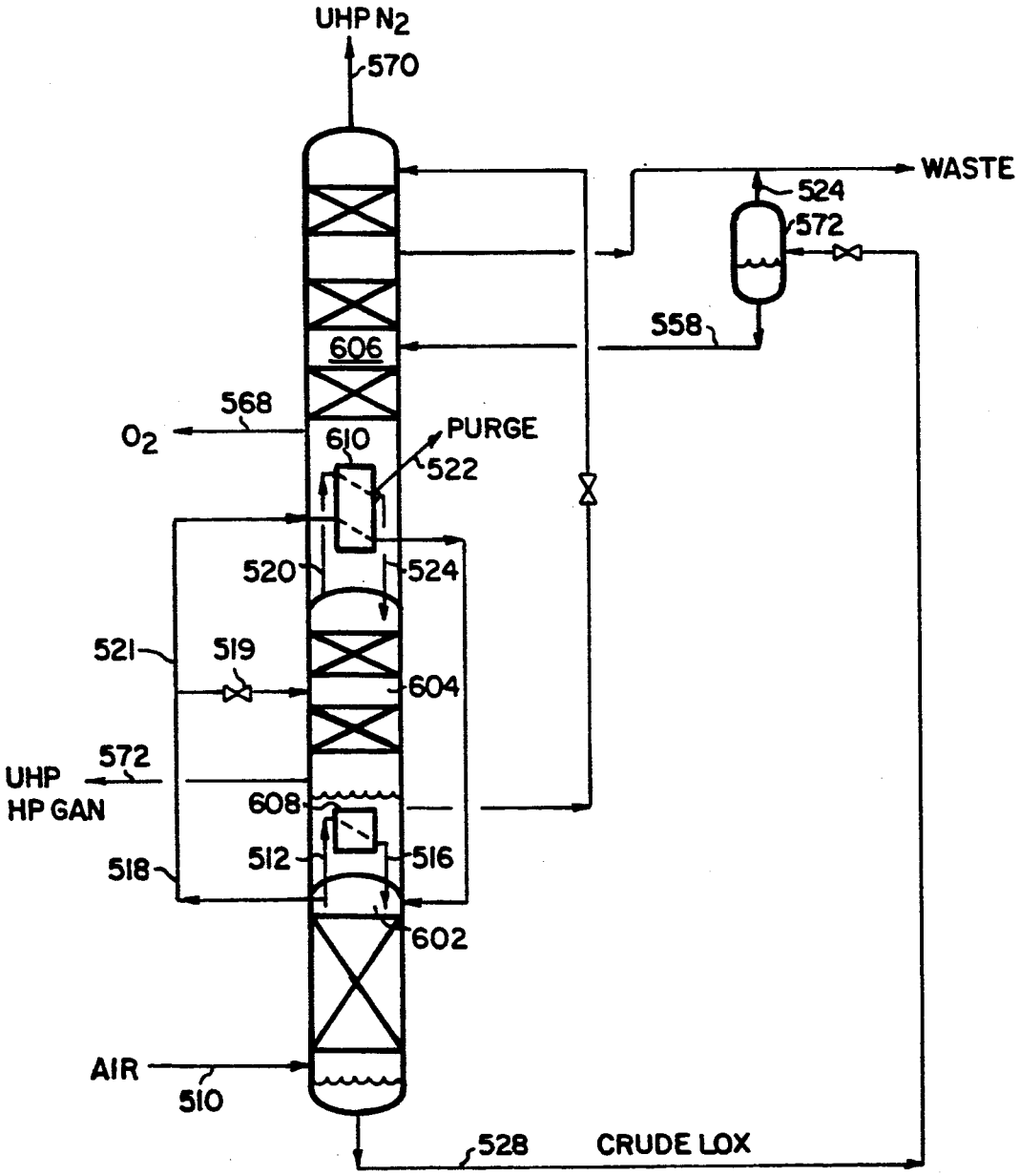
FIG. 5 is a schematic representation for generating ultra high purity nitrogen and oxygen.

FIG. 5 is a variation of the process described in FIG. 1 in that it involves the generation of ultra high purity nitrogen at two pressure levels. The FIG. 5 process also involves coproduction of oxygen and ultra high purity nitrogen. More particularly air is introduced to first column 602 via line 510 wherein a nitrogen rich fraction is generated and removed from the first column 602 via line 512 and condensed in boiler/condenser 608. A portion of the nitrogen rich vapor fraction is removed via line 518 wherein a portion is removed via line 519, expanded and charged to an intermediate point in ultra high purity nitrogen column 604. The balance is removed via line 521 and condensed in boiler/condenser 610 located in the bottom of third column 606. That portion of the condensed nitrogen fraction is returned as reflux to first column 602. As with the process in FIG. 4, a nitrogen fraction rich in volatile components is removed from an upper portion of ultra high purity nitrogen column 604 via line 520 and partially condensed. The uncondensed portion is removed as a purge via line 522 and the condensed portion is returned to column 604 via line 524. As with the embodiments in FIGS. 1 and 2, crude liquid oxygen is removed from first column 602 via line 528. Its pressure is decreased across a valve to the pressure of third column 606 and then it is fed to phase separator 572. The liquid is separated from the vapor in phase separator 572 with the liquid being introduced to the third column 606 via line 558. The flashed vapor 524 from separator 572 is mixed with the waste stream. An ultra high purity gaseous nitrogen product is removed via line 570 from third column 606. A higher purity oxygen stream is removed via line 568 from the bottom of third column 606.

Further embodiments of FIGS. 1–5 are envisioned. For example, FIG. 1 shows modifications to a single distillation column nitrogen generator producing nitrogen at pressures greater than 60 psia. In this embodiment, ultra high purity nitrogen is shown as gaseous product but if needed, liquid nitrogen of ultra high purity can also be withdrawn from the bottom of this ultra high purity nitrogen column. The use of additional separation stages (trays or packing) above the withdrawal point of the contaminated nitrogen vapor from the first column is optional. One may eliminate purging of volatile contaminants from the boiler/condenser located at the top of this column. However, if a purge is not taken, then the amount of distillation duty needed to remove light contaminants from the nitrogen in the ultra high purity nitrogen column will increase.

Another optional modification of FIG. 1 would show the withdrawal of a portion of the contaminated nitrogen vapor stream from the first column, condensation in the boiler/condenser located at the top of the ultra high purity nitrogen column and the returning of liquid to the first column as a liquid reflux stream. By condensing a portion of the contaminated vapor stream from the first column in the boiler/condenser located at the top of the ultra high purity nitrogen column and returning the condensed liquid as reflux to the first column, one can reduce the vapor flow in the ultra high purity nitrogen column and also the heat duty needed in the boiler/condenser located at the bottom of this column. As a result, the diameter of the ultra high purity nitrogen column and the size of the bottom boiler/condenser may be decreased making the process even more attractive. One reason that it is possible to split, i.e., withdraw a portion of the contaminated nitrogen vapor stream from the first column, is that the vapor flow needed at the bottom of ultra high purity nitrogen column to strip the descending liquid of the light impurities is relatively small; i.e., the L/V in the bottom section of the ultra high purity nitrogen column is much higher than 1 (usually higher than 5). This decreases the need for the boilup in the bottom of the ultra high purity nitrogen column and allows the condensation of some nitrogen vapor from the first column directly in the boiler/condenser located at the top of the ultra high purity nitrogen column.

FIG. 2 shows an embodiment where the ultra high purity nitrogen column operates at a pressure similar to the pressure in the first column. In the process of FIG. 2, two types of gaseous nitrogen products are produced. A large fraction of gaseous nitrogen is produced at a purity typical of standard cryogenic processes (standard purity nitrogen, e.g., less than 5 ppm oxygen) while the rest is produced as ultra high purity nitrogen. By adding trays at the top of the first column and above the regular nitrogen product withdrawal point, one can reduce the concentration of impurities heavier than nitrogen (such as oxygen, argon and carbon monoxide) to the ultra high purity nitrogen column. As a result of the pressure of the columns being the same, the bottom of the ultra high purity nitrogen column can no longer be boiled by the nitrogen stream obtained from near the top of the first column. Thus, the required boilup is provided by condensing a portion of the feed air stream in the boiler/condenser located at the bottom of the ultra high purity nitrogen column. Alternatively, either all or a portion of this heat duty could be provided by heat exchange against the $O_2$-rich (crude liquid oxygen) liquid from the bottom of the first column. The ultra high purity nitrogen product is withdrawn from the bottom of the ultra high purity nitrogen column.

It is worth mentioning that in cases where heat duty at the bottom of the ultra high purity nitrogen column is provided by condensing a nitrogen stream, it is possible to keep the pressure of the ultra high purity nitrogen and the first column the same. In such cases, a gaseous nitrogen stream obtained from the first distillation column could be warmed, boosted in pressure, recycled, cooled and then condensed in the boiler/condenser located at the bottom of the ultra high purity nitrogen column.

In FIG. 3, use of trays in the fourth column can be optional. If trays are not used, all of the vapor from the boiler/condenser located at the top of the third column 606 is fed to the ultra high purity column. A gaseous purge would not be taken via line 339.

FIG. 5 describes an embodiment where both oxygen and ultra high purity nitrogen products are produced. Once again the relationship between the ultra high purity nitrogen column and the first column is very similar to the one shown in FIG. 1 except that nitrogen vapor from the top of the ultra high purity nitrogen column is condensed against a higher purity oxygen now at the bottom of the third column and not against crude liquid oxygen. Furthermore, in FIG. 5 crude liquid oxygen from the first column is flashed in a separator and the liquid from this separator is fed to the third column. The vapor is mixed with the waste stream from the third column. The liquid nitrogen reflux to the third column comes from the bottom of the ultra high purity nitrogen column and not from the first column. These two steps keep the concentration of the lights in the third column extremely low and, therefore, gaseous nitrogen from the top of the third column is of ultra high purity. Optionally, a column containing packing, trays, etc. can be substituted for separator 572 to concentrate volatile impurities in the vapor phase and minimize the concentration of volatile impurities in the liquid feed stream 558.

In summary, the current invention recognizes that when a cooled air feed is distilled in a first column, the nitrogen vapor near the top of the column which is concentrated in light contaminants can be judiciously distilled in a ultra high purity nitrogen column to provide a nitrogen stream which is exceptionally lean in the light contaminants. This is achieved by the judicious integration of the reflux and boilup needs of the ultra high purity nitrogen column with the first column in the cryogenic air separation process. More particularly, the separation stages in the ultra high purity nitrogen column above the feed point of contaminated nitrogen vapor stream concentrate the lights in the nitrogen vapor. When the top section of the ultra high purity nitrogen column operates at reflux ratios close to unity, the vapor from the top is nearly totally condensed. The uncondensed portion of the vapor has a very high concentration of the lights, i.e., typically more than 1000 fold over that in the feed air, and purging of the stream permits the removal of lights from the system. Because the concentration of lights in the purge stream is large, the flow rate of the purge stream is fairly small and nitrogen recovery based on feed to the system remains high.

The condensation duty in the boiler/condenser located at the top of the ultra high purity nitrogen column is provided by boiling a suitable process liquid. Typically, this liquid is the crude liquid oxygen from the bottom of the first column, but at a pressure lower than that of the first column. Alternatively, a liquid derived from the crude liquid can also be boiled in this boiler/condenser. The key point is to choose a liquid such that its boilup in this boiler/condenser does not have a detrimental effect on the process.

The liquid nitrogen in the ultra high purity nitrogen column at a location near the contaminated gaseous feed has a very low concentration of the lights. This is due to very high relative volatilities of the three largest light contaminants, e.g., $H_2$, He and Ne with respect to the nitrogen. As a result, any liquid descending to the bottom section of the ultra high purity nitrogen column has very low concentrations of lights and is easily stripped of these contaminants by the ascending vapor. To maintain appropriate stripping the ratio of liquid to vapor flowrate in the stripping section of the ultra high purity nitrogen column should be greater than one (typically greater than five). The boilup at the bottom of this column is provided by a suitable process stream. When a stream other than a nitrogen stream from the top of the first column is used, one has the opportunity to produce ultra high purity nitrogen at the same pressure as in the first column.

What is claimed is:

1. In a process for the cryogenic separation of air which comprises nitrogen, oxygen and volatile impurities in an integrated multi-column distillation system, wherein the air stream is compressed, freed of condensible impurities, and cooled generating a feed for the integrated multi-column distillation system, the improvement for producing ultra high purity nitrogen at high nitrogen recovery in a multi-column distillation system comprising first column and an ultra high purity nitrogen column which comprises:

a) generating a nitrogen rich vapor fraction containing volatile impurities near the top of said first column and a crude liquid oxygen fraction at the bottom of said first column;

b) removing a nitrogen rich vapor fraction from a top section within said first column;

c) introducing at least a portion of that nitrogen rich vapor fraction from said first column to said ultra high purity nitrogen column as a feed;

d) generating a nitrogen rich vapor fraction near the top of said ultra high purity nitrogen column and an ultra high purity liquid nitrogen fraction in a lower portion of said ultra high purity nitrogen column;

e) partially condensing at least one of said nitrogen rich vapor fractions generated in step a) and d) thereby forming a condensed fraction and an uncondensed fraction rich in volatile impurities;

f) removing at least a portion of at least one of the uncondensed fractions rich in volatile impurities as a purge stream;

g) returning at least a portion of at least one of the condensed fractions generated in step (e) to at least one of the columns as reflux;

h) removing a crude oxygen fraction from the bottom portion of said first column; and, i) removing an ultra high purity nitrogen fraction as product from the ultra high purity nitrogen column.

2. The process of claim 1 wherein a nitrogen vapor fraction rich in volatile impurities is generated in the ultra high purity nitrogen column, removed and at least a portion condensed and at least a portion of the uncondensed nitrogen fraction rich in volatile impurities is discharged as a purge stream.

3. The process of claim 2 wherein at least a portion of the condensed fraction obtained on the condensation of the nitrogen rich vapor fraction from the ultra high purity nitrogen column is returned to the ultra high purity nitrogen column as reflux.

4. The process of claim 3 wherein at least a portion of the nitrogen vapor fraction removed in step (b) is expanded and introduced as a feed into said ultra high purity nitrogen column at lower pressure than in said first column.

5. The process of claim 4 wherein a nitrogen rich vapor is generated in the first column and at least a portion of the nitrogen fraction is removed from the first column and condensed, with the uncondensed fraction being removed as a purge and the condensed fraction returned as reflux to the first column.

6. The process of claim 4 wherein the operating pressure of the ultra high purity nitrogen column is from 10–55 psia lower than the first column.

7. The process of claim 4 wherein at least a portion of crude liquid oxygen product is withdrawn from the first column and vaporized against the nitrogen vapor from the first column.

8. The process of claim 6 wherein a crude liquid oxygen product is withdrawn from the first column and vaporized against the nitrogen vapor fraction rich in volatile impurities removed from the ultra high purity nitrogen column.

9. The process of claim 3 wherein a portion of the inlet air is used to provide boilup in said ultra high purity nitrogen column prior to introduction to the first column.

10. The process of claim 9 wherein at least a portion of the crude oxygen obtained as a bottoms fraction in the first column is expanded and charged to a boiler/-condenser and vaporized against a portion of nitrogen vapor rich in volatile impurities from the ultra high purity nitrogen column.

11. The process of claim 10 wherein a nitrogen vapor fraction generated in said first column is removed as a product.

12. The process of claim 2 wherein the ultra high pressure column is operated at essentially the same pressure as the first column.

13. The process of claim 3 which comprises a third column in the distillation system.

14. The process of claim 13 wherein at least a portion of the nitrogen vapor fraction removed in step (a) is initially introduced as feed into said third column and then into said ultra high purity nitrogen column.

15. The process of claim 13 wherein at least a portion of the inlet air is used to effect boilup in the ultra high purity nitrogen column.

16. The process of claim 14 wherein the operating pressure of the ultra high purity nitrogen column is form 10–55 psia lower than the first column.

17. The process of claim 15 wherein a crude liquid oxygen product is withdrawn from the first column and vaporized against the nitrogen vapor fraction rich in volatile impurities removed from the third column.

18. The process of claim 17 wherein crude liquid oxygen is expanded and charged to an upper portion of a fourth column with a portion of resulting vaporized oxygen removed as a purge and the resulting liquid allowed to descend the fourth column and strip volatile impurities from vaporized oxygen generated in the condensation of the nitrogen vapor fraction rich in volatile impurities.

19. The process of claim 13 wherein the crude liquid oxygen from the first pressure column is expanded and volatile impurites flashed therefrom in a separator.

20. The process of claim 19 wherein at least a portion of the liquid obtained from the separator is returned to an upper portion of the third column.

* * * * *